US005249500A

United States Patent [19]

Husseiny et al.

[11] Patent Number: 5,249,500

[45] Date of Patent: Oct. 5, 1993

[54] RAPID AREA CLEARANCE OF EXPLOSIVES

[75] Inventors: Abdo A. Husseiny; Zeinab A. Sabri, both of LaPlace, La.

[73] Assignee: Technology International Incorporated, LaPlace, La.

[21] Appl. No.: 11,788

[22] Filed: Feb. 1, 1993

Related U.S. Application Data

[62] Division of Ser. No. 877,198, May 1, 1992, which is a division of Ser. No. 586,150, Sep. 21, 1990, Pat. No. 5,140,891.

[51] Int. Cl.[5] ..... F42D 5/04; F42B 33/00

[52] U.S. Cl. ..... 89/1.11; 89/1.1; 89/1.13

[58] Field of Search ..... 89/1.11, 1.1, 1.13; 102/402; 86/50

[56] References Cited

U.S. PATENT DOCUMENTS

| | | | |
|---|---|---|---|
| 3,265,598 | 8/1966 | Rohrman | 89/1.13 |
| 3,721,201 | 3/1973 | Boller | 86/50 |
| 3,771,413 | 11/1973 | Sieg et al. | 89/1.13 |
| 3,800,715 | 4/1974 | Boller | 86/50 |
| 4,046,055 | 9/1977 | McDanolds et al. | 86/50 |
| 4,493,239 | 1/1985 | Pedersen | 89/1.13 |
| 4,840,105 | 6/1989 | Ladan et al. | 89/1.13 |
| 4,919,034 | 4/1990 | Firth | 89/1.13 |
| 4,957,027 | 9/1990 | Cherry | 86/50 |

*Primary Examiner*—David H. Brown

*Attorney, Agent, or Firm*—Sixbey, Friedman, Leedom & Ferguson

[57] ABSTRACT

A system and process for neutralizing unexploded ordinances and clearing explosive infested areas such that maneuvers can be both readily and confidently continued without significant delay is disclosed. The system clears such unexploded ordnances infested areas by initially spraying the explosive infested area with a cryogenic liquid to supercool the unexploded ordinances and reduce an output voltage of a detonator of the unexploded ordinances thereby rendering the unexploded ordinances inert, gathering the now unexploded ordinances and submerging the inert unexploded ordinances in a tank containing the same or similar cryogenic liquid so that the unexploded ordinances are maintained in a supercooled and inert state to allow for disposal. Alternatively, the neutralization of unexploded ordinance and clearing of explosive infested areas may be carried out by spraying the explosive infested area with liquefied methane to supercool the unexploded ordinance and reduce an output voltage of a detonator of the unexploded ordinances to render such ordinance inert, igniting the liquefied methane, deflagrating the unexploded ordinances at a temperature less than that required for detonation and subsequently removing the neutralized ordinances from the explosive infested area.

4 Claims, 2 Drawing Sheets

RAPID AREA CLEARANCE OF EXPLOSIVES

This is a divisional application of Ser. No. 07/877,198, filed May 1, 1992, which itself was a divisional of Ser. No. 07/586,150, filed Sep. 21, 1990, now U.S. Pat. No. 5,141,891.

TECHNICAL FIELD

The invention relates generally to a system for the rapid area clearance of unexploded ordinance from critical air base facilities or explosive infested ranges. More particularly, the present invention relates to a system for neutralizing unexploded ordinance so that such unexploded ordinance may be safely removed from the infested area.

BACKGROUND OF THE INVENTION

Historically, explosive-filled ordinance such as mines and hidden explosive devices have proven to be a significant obstacle to be overcome in both low and high intensity conflicts. Mines and hidden explosive-filled ordinance destroyed over 25 percent of the vehicles lost in World War II, a percentage that almost tripled in the Viet Nam War. Because of the continued improvement in flexibility, sophistication, kill power, ease of use and effectiveness of such mines, the potential for the continued use of such mines and hidden explosives for area denial and barrier munitions will continue to play a vital role in successful defensive tactics.

Current explosive-filled ordinance neutralization techniques include plows, rollers or flails attached to the front of an armored vehicle, as well as projected explosive charges. One such technique is illustrated in U.S. Pat. No. 3,771,413 issued to Sieg et al. The mine neutralization device of this type employs wheels which are mounted on the vehicle, such as a tank, and are utilized to neutralize; i.e., detonate pressure actuated land mines buried in the ground which are in the vehicle's path of travel. Such neutralization techniques are rarely used until the presence of a mine field is established; and once established, these techniques are slow and vulnerable to covering fire. A mine field protected by covering fire can be extremely difficult to breach. Further, some of the mines in the mine field may be missed because of the use of an advanced fuse system or the use of infrequent individual mines.

The range clearance system set forth in U.S. Pat. No. 4,449,239 issued to Pedersen illustrates a method of clearing a target range or other areas such as a war zone of buried unexploded ordinance by enhancing oxidation of ferrous ordinance in situ. This method advances the natural galvanic electrochemical corrosion whereby ferrous parts of the unexploded ordinance are simply rusted away at an accelerated rate and rendered harmless within five to ten years. However, while such a system may be effective in clearing a target range for future use, this system is both impractical and unusable where it is desired to quickly and effectively clear explosive infested areas such that troops or other personnel may readily occupy the previously infested area.

Various other techniques have been employed to neutralize explosive devices. Examples of such are set forth in U.S. Pat. No. 4,046,055 issued to McDaniels et al. and U.S. Pat. No. 3,800,715 issued to Boller. Each of these devices employ the use of liquid nitrogen to cool the device to a temperature at which the device becomes inoperative. One such device requires penetrating the individual casing of the unexploded ordinance with the subsequent injection of liquid nitrogen into the device. With the device of Boller, an unexploded ordinance is drawn into an open-ended tubular shell which is then filled with liquid nitrogen to freeze the bomb to deactivate the explosive material contained therein. However, each of these devices is used to merely deactivate a single bomb and cannot readily or safely be used to neutralize unexploded ordinance scattered over a large explosive infested area. Remote clearing of mine fields from a distance may also be carried out by the use of projected explosive charges which can quickly clear paths. This procedure; however, requires large amounts of explosives and causes large airblasts which are often undesirable. Moreover, this procedure is often only effective in detonating single-impulse pressure mines. Consequently such a procedure may not reliably clear the unexploded ordnance infested area.

Clearly, there is a need for both a system and method for readily neutralizing unexploded ordinance and clearing explosive infested areas such that maneuvers may be continued in a rapid and a confident manner. Further, such neutralization and clearing must be capable of being carried out safely with the unexploded ordinance being continuously maintained in an inert state.

SUMMARY OF THE INVENTION

It is an object of the present invention to overcome the shortcomings associated with the above referenced prior art.

It is yet a further object of the present invention to provide a system that copes with all possible variations in expected unexploded ordnance types with reference to range, type and characteristics of explosive contained therein as well as volume, weight, arming/fusing devices, influence, etc. Further, the system must account for the anticipated future development of munitions, including area denial munitions, combined effects munitions, smart weapons, sophisticated munitions, canister bomb units, submunitions, scatterable munitions and mines.

Rarely is the attack on an air base continuous, thus area denial munitions are often included as part of the attack so as to prolong the attack's effect. Therefore, it is yet another object of the present invention to provide a system which renders such area denial munitions inert and safe to remove.

Another object of the present invention is to provide a method of neutralizing unexploded ordinance and clearing explosive infested areas such that maneuvers can be both readily and confidently continued without significant delay. This may be accomplished by initially spraying the explosive infested area with a cryogenic liquid to supercool the unexploded ordinance and reduce an output voltage of a detonator of the unexploded ordinance thereby rendering the unexploded ordinance inert, gathering the now inert unexploded ordinances and submerging the inert unexploded ordinances in a tank containing the same or similar cryogenic liquid so that the unexploded ordinances are maintained in a supercooled and inert state and disposing of the unexploded ordnances.

In addition to the above, the neutralization of unexploded ordinance and clearing of explosive infested areas may be carried out by spraying the explosive infested area with liquefied methane to supercool the unexploded ordinance and reduce an output voltage of a detonator of the unexploded ordinance to render such ordinance inert, igniting the liquefied methane, deflagrating the unexploded ordinance at a temperature less than that required for detonation and subsequently removing the unexploded ordinance from the explosive infested area.

Yet another object of the present invention is to provide a system for carrying out the above-mentioned process without subjecting personnel to unnecessary risk of explosion. The system includes a device for dispersing the cryogenic liquid about the explosive-infested area to render the unexploded ordnances inert, an armored bulldozer or similar device for gathering the inert unexploded ordnances, and a removal device for removing the gathered unexploded ordnances from the explosive-infested area.

DETAILED DESCRIPTION OF THE PREFERRED EMBODIMENT

Figure 1:
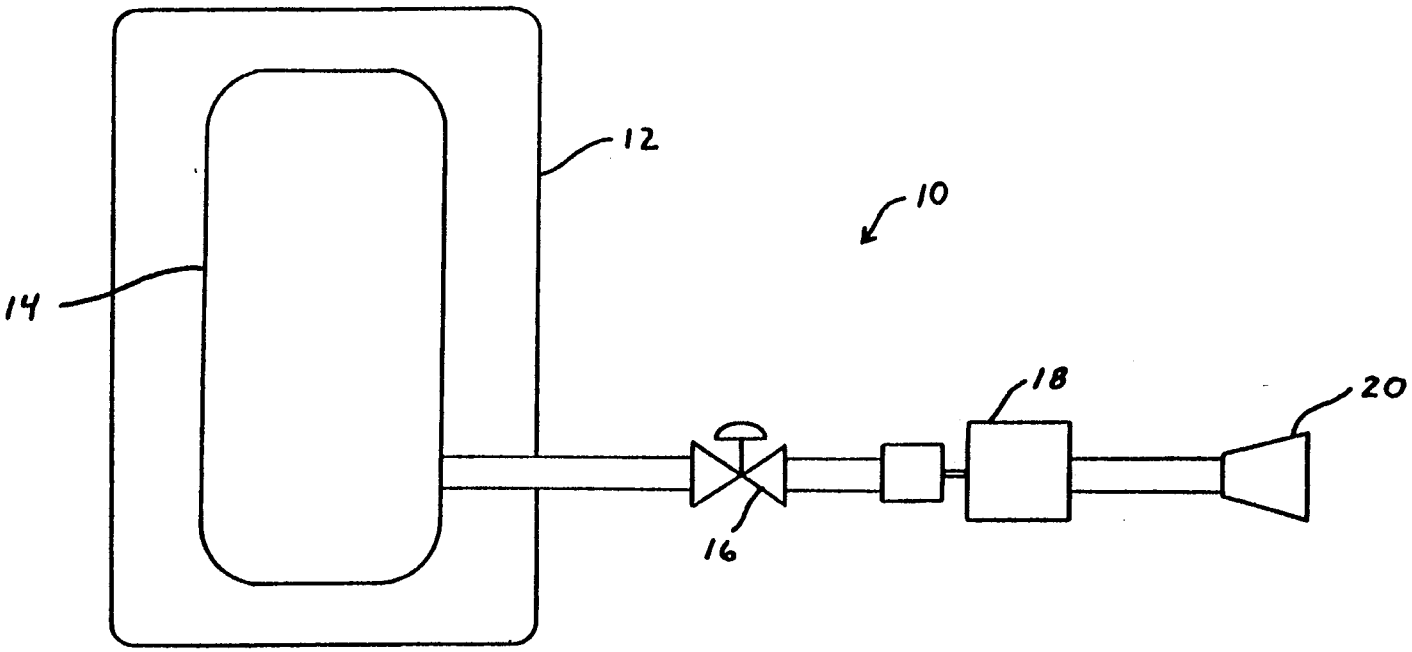
FIG. 1 is a schematic illustration of the neutralization system in accordance with the present invention.
Figure 2:
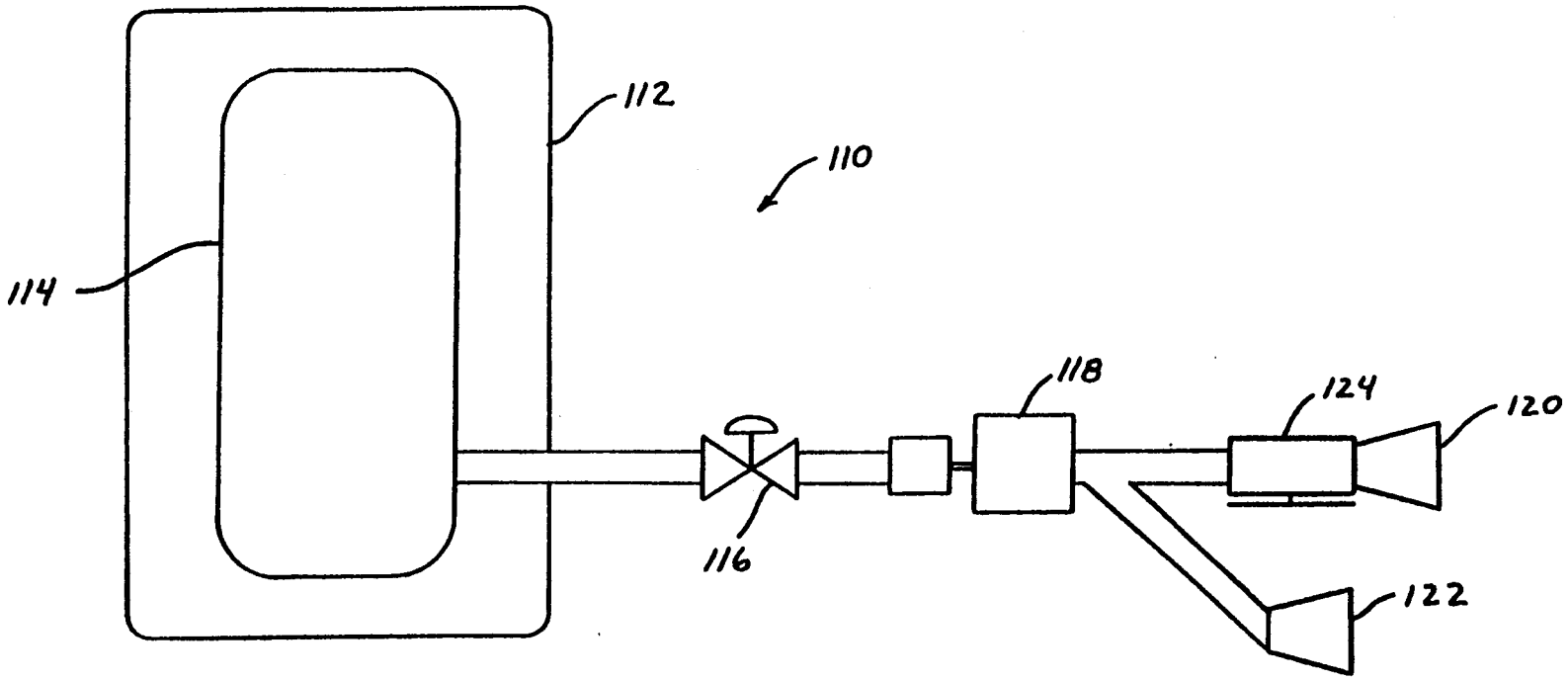
FIG. 2 is a schematic illustration of the neutralization system in accordance with an alternative embodiment of the present invention.

Referring now to FIGS. 1 and 2, the cryogenic system for disbursing cryogenic liquids about an explosive infested area is illustrated. FIG. 1 illustrates a dispersion unit 10 which may be readily mounted on the underside of a helicopter. The dispersion unit 10 includes an insulated refrigeration tank 12 which accommodates a cryogenic liquid storage tank 14. The flow of the cryogenic liquid is controlled by the valve 16 which when opened allows the cryogenic liquid from tank 14 to be pumped by the centrifugal pump 18 through the dispersion nozzle 20. While the particular characteristics of the dispersion nozzle 20 are not critical to the operation of the dispersion unit 10, the nozzle must be capable of dispersing cryogenic liquid over a large area.

Similarly, the dispersion unit 100 illustrated in FIG. 2 includes an insulated refrigeration tank 112 which receives a cryogenic liquid storage tank 114. The flow of cryogenic liquid through the dispersion unit 110 is controlled by valve 116 with a centrifugal pump 118 being of the capacity to supply a significant amount of cryogenic liquid through the upper dispersion nozzle 120 and lower dispersion nozzle 122. Because the dispersion unit 110 is to be mounted on a land vehicle, in order to disperse cryogenic liquid over a significant area, the upper dispersion nozzle 120 is mounted on a turret 125 so as to enable the upper dispersion nozzle 120 to pivot to and fro in order to disperse the cryogenic liquid over a path which is at least three times the width of the vehicle, or approximately 20–30 feet. The lower dispersion nozzle 122 is mounted close to the ground so as to soak an area approximately the width of the vehicle with cryogenic liquid. Each of the dispersion nozzles 120, 122 are also be mounted so as to disperse the cryogenic liquid at least 100 feet ahead of the vehicle. This allows for the immediate cooling of the unexploded ordinance prior to the time at which the vehicle reaches the unexploded ordinance.

In accordance with a first embodiment of the present invention, the cryogenic liquid storage tank 14, 114 may be filled with a variety of cryogenic liquid such as liquid nitrogen or liquid air. Liquid nitrogen would, in effect, be the preferred cryogenic liquids in that the presence of oxygen in liquid air may enhance the ever present threat of fire when dealing with flammables. Consequently, liquid nitrogen which is not readily susceptible to fire would be the preferred cryogenic liquid to be used in accordance with the present invention.

The cryogenic liquid may be either remotely produced and brought to the site for dispersion or produced by a mobile cryogenic liquid production plant of a capacity sufficient enough to produce an amount of cryogenic liquid appropriate to disperse a sufficient layer of cryogenic liquid over an unexploded ordinance infested area such as an air base. Mobile cryogenic liquid production plants capable of producing the requisite amounts of such product are presently commercially available.

Once produced, the cryogenic liquid is dispersed over an area by use of either the dispersion unit 10 which is carried by a helicopter or the dispersion unit 110 which is mounted to a land vehicle such as a tank. When using the latter system, a magnetic silencer and signature reduction devices must be fitted to the delivery vehicles so as to reduce noise and vibrations admitted by the vehicle in order to minimize the chance of the detonation of influence fusing unexploded ordinances. If a significant amount of influence fusing unexploded ordinance are present, a low influence remotely controlled robotic vehicle would be used to allow the neutralization process to be safely implemented. However, if influence fusing unexploded ordinances are not present, the use of a helicopter as a delivery vehicle would more efficiently and more expeditiously render the infested area neutralized.

Once a specified area has been adequately covered by layer of approximately ½ inch of cryogenic liquid, the unexploded ordinances will be neutralized by the supercooling interference with the detonator within the explosive process. The system supercools what are known as smart munitions to reduce the battery output voltage to the point that electronic fusing will not function. The supercooling of the batteries of the unexploded ordinances causes a malfunction in the detonator and renders the unexploded ordinance inert or at least unable to detonate while supercooled.

Once the unexploded ordinances are rendered inert, they may be removed from the infested area by the use of an armored bulldozer or other type of removal equipment 210. The removal equipment may also be remotely controlled in order to ensure the safety of the operating personnel. Once the now neutralized unexploded ordinances are gathered together in one area, the unexploded ordinances may again be soaked with the cryogenic liquid in order to ensure the neutralization of the unexploded ordinances. The unexploded ordinances must then be reliably transported away from the infested area. In order to do so, the unexploded ordinances are placed in a tank 220 containing the cryogenic liquid so that the unexploded ordinances may be safely transported. The unexploded ordinances may be picked up by a remote manipulator so as to again ensure the safety of the operating personnel. Because the unexploded ordinances are now held safe in a supercooled state, the final disposition of the unexploded ordinances may be either done immediately or delayed until such time that the proper equipment and personnel may be used.

The system described hereinabove may be used for the neutralization of unexploded ordinances of a variety of types. The above neutralization system is effective regardless of the range, type an characteristics of the explosive contained within the unexploded ordinance, volumes, weights, arming/fusing devices, etc. as well as anticipated future development of explosive ordinances. Moreover, because the neutralized unexploded ordinances are removed by an armored vehicle having a plow-type structure on its front, additional debris such as fragments of explosives as well as other objects that are found on runways or other infested areas will be removed.

The preceding embodiment of the present invention first sprays an area of approximately 25 feet in width and 100 feet in length, the armored vehicle then plows the sprayed area in order to move the unexploded ordinances to a small concentrated area. To be sure that the unexploded ordinances remain neutralized, the piled unexploded ordinances may be sprayed with an additional amount of cryogenic liquid. The removal vehicle then picks up the piled and neutralized unexploded ordinances and loads the unexploded ordinances into a tank containing the same or similar cryogenic liquid. Once the tank has been filled with unexploded ordinances, it is securely closed and transported for disposal and replaced by another tank containing the cryogenic liquid. This process would continue until the entire infested area has been neutralized.

As an alternative to the preceding embodiment of the present invention, cryogenic liquid methane or natural gas may be used as the neutralizing cryogenic liquid. In addition to the foregoing, a system employing cryogenic liquid methane is effective in neutralizing anti-personal and anti-amphibious vehicle mines usually encountered in surf areas, as well as those encountered on land.

The cryogenic liquid methane cools the mines to a temperature that renders the mines safe to burn without explosion and without the associated air blast. The effects of the very low temperatures on the unexploded ordinances causes the malfunction of the ignites and renders the explosives inert or at least unable to detonate while supercool by reducing the battery output voltage of the detonator to the point that electronic fusing will not function. The cryogenic liquid methane may be produced by cascade refrigeration using several refrigerants in series. The refrigeration process would include cooling the gas, first by propane, then by ethylene, and finally by self-refrigeration. The ethylene is condensed by propane and the propane is condensed by water. The final methane pressure reduction may be achieved by the well-known Joule-Thomas effect of cooling by throttling. As with the previous embodiment, the cryogenic liquid methane may be brought to the site in tanks or produced in situ aboard the vehicle depending upon the type and size of the mine field to be cleared.

When neutralizing surf mines, a helicopter is used as the delivery vehicle; however, when influence fusing unexploded ordinances are present in a field, a low influence remotely controlled robotic vehicle should be used to carry out the neutralization process. In either case, the delivery vehicle will spray the infested area with cryogenic liquid methane or natural gas which is then followed by the remote deflagration of the unexploded ordinances. In doing so, the explosives will burn but will not explode.

When neutralizing an unexploded ordinance infested surf area, a helicopter or other robotic aircraft carrying the dispersion unit 10 set forth in FIG. 1 is used to disperse cryogenic liquid methane about the area to be cleared. In addition to the dispersion unit 10, an igniter containing flammable material and an adhering material for ignition of the boiling methane dispersed about the area will also be carried by the helicopter along with a launcher to launch the flammable igniter.

The neutralization of the unexploded ordinance infested area is carried out by initially spraying an area of approximately 15 feet by 150 feet with the cryogenic methane, backing off away from the area and launching the igniter into the area to burn the disabled mines. Once this is accomplished, a new area is sprayed and the process is repeated until the entire area is neutralized. Each section takes approximately 4–5 minutes to burn when a layer of approximately ½ inch of cryogenic liquid methane is dispersed.

The igniter which initiates the deflagration of the enabled mines may consist of a canister containing a highly flammable liquid such as methane and an adhesive such as rubber to ensure the ignition of a localized area. The igniter would thereby be similar to a Molotouf cocktail.

When clearing mine fields where the mines are either on the surface of the ground or buried a depth of four inches or less, a low influence armored vehicle, including the dispersion unit 110, illustrated in FIG. 2 would be used in dispersing the cryogenic liquid methane. The low influence armored vehicle would also include a launcher for launching an igniting canister. The armored vehicle would initially spray a specified area with a layer of cryogenic liquid methane. The armored vehicle would then back away from the sprayed area and launch an igniter containing a highly flammable liquid and an adhesive such as rubber into the sprayed area, thereby igniting the boiling liquid methane. Upon the total deflagration of the explosives in the initial area, the armored vehicle would then proceed to an adjacent area to be neutralized. Upon the total deflagration of the explosives, the now neutralized unexploded ordinances may be readily removed from the neutralized area by gathering the now neutralized shells, thus allowing personnel to occupy the area.

Therefore, by carrying out the above described procedures, a workable solution for the complete, overall and rapid clearance of unexploded ordinances from an infested area is provided. Furthermore, the above described systems provides a highly reliable neutralization system which is easy to deploy and capable of clearing large areas at high sweeping rates, with minimal logistics and manpower support.

While the invention has been set forth with reference to particular embodiments, it will be appreciated by those skilled in the art that the invention may be practiced otherwise than has been described without departing from the spirit and scope of the invention. It is, therefore, to be understood that, the spirit and scope of the invention is to be limited only by the appended claims.

Industrial Applicability

While the above-described invention is particularly suited for the neutralization and the clearing of areas infested by unexploded ordinances, after an attack, the present invention may also be employed to clear artillery ranges and other test facilities of unexploded ordinances or to freeze food crops, as well as sea food crops, in situ prior to their harvesting.

What is claimed is:

1. A method of neutralizing unexploded ordnance and clearing explosive-infested areas comprising the steps of;

spraying the explosive-infested area with liquefied methane to super-cool the unexploded ordnance and reduce an output voltage of a detonator of the unexploded ordnance to render the unexploded ordnance inert;

igniting the liquefied methane;

deflagrating the unexploded ordnance at a temperature less than that required for detonation; and removing the unexploded ordnance from the explosive-infested area.

2. The method as defined in claim 1, wherein the step of igniting the liquefied methane includes launching an igniter into the explosive-infested area.

3. The method as defined in claim 2, wherein said igniter includes a flammable liquid and an adhesive agent contained in a canister.

4. The method as defined in claim 3, wherein said adhesive agent is rubber.

* * * * *